United States Patent [19]

Henig

[11] 4,287,672

[45] Sep. 8, 1981

[54] PROCESS AND APPARATUS FOR DRYING PIECES IN BULK IN A PLATING BARREL

[76] Inventor: Hans Henig, Albrecht-Achilles-Str. 48, 8500 Nünberg, Fed. Rep. of Germany

[21] Appl. No.: 64,988

[22] Filed: Aug. 9, 1979

[30] Foreign Application Priority Data

Aug. 18, 1978 [DE] Fed. Rep. of Germany ..... 2836183

[51] Int. Cl.[3] ..... F26B 3/04

[52] U.S. Cl. ..... 34/28; 34/34; 34/77; 34/133; 118/418; 427/433; 432/107

[58] Field of Search ..... 118/418; 427/433; 432/112, 107; 34/63, 55, 133, 23, 28, 31

[56] References Cited

U.S. PATENT DOCUMENTS

| | | | |
|---|---|---|---|
| 3,001,297 | 9/1961 | Plumer | 34/133 |
| 3,767,554 | 10/1973 | Noonan | 118/418 |
| 3,768,173 | 10/1973 | Jessup et al. | 34/133 |
| 3,934,545 | 1/1976 | Schady | 118/418 |
| 3,939,054 | 2/1976 | Singleton | 118/418 |
| 3,972,130 | 8/1976 | Mason | 34/55 |
| 4,162,680 | 7/1979 | Coch | 118/418 |

*Primary Examiner*—Larry I. Schwartz
*Attorney, Agent, or Firm*—Holman & Stern

[57] ABSTRACT

A method and apparatus for drying pieces in bulk, such as metal screws being electrolytically galvanized. The pieces are charged in a rotating perforated barrel through which drying air is passed. The barrel is positioned in a drying chamber which also contains a ventilator for circulating the air, an air heater and a dehumidifier. These components are arranged so that dry air is drawn through the barrel and the charge by vacuum from the portion of the barrel not filled by the charge. Flexible seals between the barrel outer casing and a suction box direct the flow of air substantially completely through the charge.

5 Claims, 2 Drawing Figures

28
25
24
26
22
23
24
1
2
13
33
15
14
32
31

PROCESS AND APPARATUS FOR DRYING PIECES IN BULK IN A PLATING BARREL

BRIEF SUMMARY OF THE INVENTION

The present invention concerns a process and an associated apparatus for drying of pieces in bulk, consisting of metallic or synthetic materials, by means of an air flow in a rotating plating barrel which is suitable for the chemical or galvanic surface-treating of said bulk material, and whereby said plating barrel substantially comprises two front sections which are arranged to be perpendicular to the axis of the barrel, and whereby a perforated covering of a polygonal cross-section is located between the two front sections.

The plating barrels, for the purpose of galvanization, are provided with an opening for the loading and removal of the bulk pieces to be treated. The opening is sealed by means of a removable lid.

A barrel which, for example, is loaded with metal screws which are being electrolytically galvanized, has to pass through a series of treatment steps which, in general, may consist of a cycle of solutions for the chemical degreasing, pickling, electrolytic galvanization and, if the situation requires, the passivation. Furthermore, a rinsing with water is done between the individual solutions. Each one of the treatment steps represents a treating-station; the individual solutions are contained in tubs. The galvanized pieces in bulk are wetted with water after leaving the last treating-station, e.g., they are wet and must be dried. The technical practice proposes for this purpose exclusively the transfer of the wet pieces in bulk from the plating barrel to a centrifuge in which the pieces are dried. There were done many tests to perform the drying process in the barrels themselves. The state of the art has proven, however, that these tests have not found a place in the practice and should therefore be evaluated as being insufficient with regard to their effectiveness.

A barrel has been known in the art which is provided with a centrically-arranged pipe for supplying liquids (predominatly for the purpose of rinsing) as well as air into the inside of the barrel. The central pipe is provided with nozzles through which air is to be blown into the charge of bulk pieces which are located below said pipe. The amount of air blown thereinto, as well as the spatial distribution of the air-flow in the barrel, are insufficient to enable the intended drying within a reasonable time limit. The arrangement of the central pipe is costly and interferes to a great extent with the guiding of the galvanization-flow by means of cable or other structural elements into the inside of the barrel, due to its central seating. The guiding of the galvanization-flow into the plating barrel, however, is an absolute requirement for the performance of the galvanization process.

It has furthermore been proposed to provide a barrel with a cover having a perforation with outwardly-directed conical widenings. The proposed embodiment should present the least possible resistance to the air flow directed from the outside to, and impaction on, the barrel cover during the flow through the barrel cover. It is known, however, from fluid-dynamics, that the circulation of gaseous bodies in conductors having narrowing cross-section, will result in local turbulences, which confine the flow beyond the geometric spatial form of the cross-section. The proposed form of perforation produces thus a turbulent flow in which local, subordinated mixing motions are being superimposed on the main movement, and thus lead to a substantial increase of the flow-resistance, namely, to a reduction of the flow volume. The proposed conical perforations cause thus an effect which has a disadvantageous result.

The charge inside the plating barrel to be dried forms a conglomerate of bulk pieces. The problem to be solved resides in the drying of the entire surface area of the charge, which consists of the sum of all surface areas of all individual parts of the charge. But, if the air flow does not penetrate the charge, i.e., if the air flow does not flow through the charge, then said air flow touches only the cover area of the charge and thus has a drying effect over only an extremely small fraction of the total surface area of the bulk pieces to be dried.

The first as well as the second mentioned prior art plating barrels consequently are unable to propose a technical solution for guiding a directed air flow transversely through the conglomorate of bulk pieces in the plating barrel. It is therefore obvious that the two types of barrels have only a very small and accordingly insufficient degree of effectiveness for a drying process within a barrel itself.

It has therefore been proposed to force the air flow through the perforations of the barrel cover. Said plating barrel is placed into a prismatic chamber, which is denoted as a drying station. In a lower, lateral corner there is located a box which is fixedly connected to the chamber; the form of said box being adapted to the polygonal barrel-cover and through which air is blown ionto the perforated cover of the barrel. The barrel, with a portion of its cover, is therefore placed on the above-described air-input box. It is important in this connection to note that the area of the barrel-cover which is placed onto the box corresponds approximately with a quarter space of the surface area of the cover of the barrel.

On the upper and lower edge of the air-input box there are mounted two restrictors consisting of a flexible material, which rest frictionally on the barrel-cover during its rotational movement. When air is being blown through the input-box onto the quarter-portion of the barrel cover resting thereon, then this air cannot escape and is thus forcibly pressed into the inside of the barrel. The results, at first, are flow-mechanically conditioned bafflings of the air flow during entry into the perforations of the barrel cover, and a corresponding reduction of the air volume, i.e., the drying effect.

The volume of the barrel is filled to a third of its capacity with the charge; the barrel is able to rotate in two directions.

If rotation is made in a manner whereby the charge is moved away from the air-input box, then the air, forced into the barrel, only grazes along over the top surface of the charge, which surface is formed by the rotational movement of the barrel, and over which the constantly-mixing pieces in bulk are tumbling down. The air determined for the drying process thus grazes only an extremely small area of the total surface area of the charge to be dried. The degree of effectiveness of the drying process is to be determined as insufficient.

When the prior art barrel is rotated counter-clockwise to the above-mentioned rotation, then the charge remains in that quarter-area of the barrel-cover which engages immediately the air-input box. The air forced into the barrel is in this case forced to flow through the barrel cover as well as through the charge.

The air-flow through the perforations blows away those bulk pieces which are located in the area of the wall of the barrel, at least partially, in the direction of flow whereby these bulk pieces may be mechanically damaged.

The barrel, as well as also the charge located therein, are wetted with liquid at the point in time where they are placed into the prior art drying chamber. It is of value to know from experience that the so-called "pull-out-losses" of the medium-sized barrel, i.e., the amount of liquid (water) adhering to the barrel and to the charge located therein, has the size order of from 1.5 to 2.5 liters. The liquid thus drops out of the barrel at a point in time where the drying process begins.

However, if the charge, during the rotation of the barrel, is located immediately on the air-input box, then the water droplets which fall downwards are being thrown back into the charge by means of the air flow which is pressed into the barrel, and there develops an effect which is diametrically counter to the desired drying effect.

It is the scope of the instant invention to dry the bulk pieces inside a galvanizing barrel by means of an air flow which most extensively overflows the entire surface areas of all bulk pieces forming the charge, and nevertheless preventing thereby the disadvantages of the prior art barrels.

The problem is inventively solved in that the air is being drawn from the barrel, namely, from that area of the inner space of the barrel which is not filled by the charge comprising the bulk pieces, transversely through the charge, and transversely through the area of the perforated barrel-cover which is in direct contact with the charge. The indraft stream is guided through the charge and through the area of the perforated barrel cover directly contacting said charge, forcibly by means of suitable structural elements which are stationarily arranged and located outside the barrel cover.

The barrel, as known in the art, is filled with the charge to about one third of its volume. A suction box is welded to that portion of the barrel cover at which the charge is located during the rotational movement. The developing underpressure in the suction box draws the air from said inside space of the barrel which is not filled with the charge, transversely through the charge, and transversely through the associated perforated barrel cover; there develops thus an indraft stream transverse through the conglomorate of the bulk pieces and the perforated barrel cover. The flow of the drying air transverse through the charge causes the total surface area of all bulk pieces to be engaged by the indraft stream branching transversely through the charge, and a maximum effect is thereby achieved. The flowing air does not immediately impinge the perforation of the barrel cover; it reaches same spatially distributed within the charge, and flows, as a result of being laminarily drawn off, through the perforations.

Developing local turbulences within the charge, however, are useful; the dry hot air is distributing itself and is charged with the moisture of the wetted bulk pieces. The local turbulences, however, are not timely constant; the charge grinds and mixes inside the barrel during the rotational movement and the position of the bulk pieces among each other changes constantly.

The charge rests on the barrel cover; the indraft stream is accordingly necessarily directed downwards, i.e., into the direction in which the liquid drops. The direction of effect of the indraft stream and the dripping of the liquid which wets the charge do thereby correspond to a great extent. As a result, the indraft stream effects an accelerated removal of liquid droplets from the charge and contributes thus to a substantial increase of the level of drying effects.

The almost vertical direction of the indraft stream (for example from top left to bottom right according to the illustrated embodiments) enables simultaneously a very high quantitative increase of the air volume, which can circulate through the charge. The flow direction presses the bulk pieces in the direction of its gravity onto the barrel cover; the danger of the charge particles being thrown from the perforated cover, as is the case with prior art barrels, is virtually impossible.

A very high air volume, however, means simultaneously a very high potential moisture-acceptance and thereby a very rapid removal of moisture from the surface area of the wetted bulk pieces, i.e., an intensive and very rapid drying.

It is obvious, that the inventive drying process in an identical constantly rotating or intermittently rotating (under certain conditions swinging) or still-standing barrel, may find use in the same manner. The identical case holds true also for the instant in that the removable lid for filling, or removing, the contents from the barrel, is being removed and the dry air flows through the inlet opening into the barrel.

A preferred embodiment of the instant invention proposes an intermittent utilization of the drying process. It is proposed to place the barrel into the drying chamber and not to permit same to rotate in a first time-phase of the duration it is in the chamber. The physics of liquid members shows some examples, which teach that the floating away of the liquid from the surface area of wetted solid members is advantageous when the same remain unchanged in their spatial position. Of course, during this time phase of the barrel standing still, the indraft flow should flow through the charge of the bulk pieces with full intensity. The natural flow direction of the droplets and the direction of effect of the indraft flow are combined into an accelerated outflow of the liquid to be dried off. After the outflow of the prescribed first time phase, the barrel is moved into rotation and the drying process is completed with a further time phase. It has surprisingly been proven that the combination of such intermittent phases, i.e., alternating the rotating and standing still of the barrel, contributes substantially to the reduction of the times required for the drying process.

The inventive drying apparatus comprises substantially a combination of the following major structural components: The barrel with the charge contained therein; a ventilating means for the constant changing of air in an open cycle within the system of the drying chamber; possibly a radiator (heat exchanger) for the heating of the changed air as well as a dehumidifier (a socalled droplet separator) for the amount of air circulating in the cycle.

Late-model installations for the chemical or galvanic surface treatment of bulk pieces in barrels generally are provided with a programmed transporting system which automatically moves the individual barrels according to predetermined time-path frames through the entire installation. The moist pieces in bulk after the last method step are presently manually transferred from the barrel into a drying centrifuge.

This working process is practically not suited for mechanization. Would there be a sufficient drying of the charge possible inside the barrel, and within a time span which complies with the time phase of the automated transporting system, then this realization would represent a substantial advancement with regard to the automation of the removal process in automatic galvanization installations. The instant invention, in all respects, fulfills completely the present requirements for advancement.

The inventive characteristics to draw the drying air from the barrel, and not to force same into the barrel, enables the flowing of large air volumes also through the cover of such barrels, which have perforations with a very small cross-section. Such small perforations are required for the galvanization of pins, small screws or nails, transistors, etc. Were one to permit the air flow to impact such barrel covers in order to force the drying air thereinto, then the turbulent developments would block entirely even the entry of air into the inside of the barrel at the small perforations, as well as at the surface area of the barrel cover itself.

BRIEF DESCRIPTION OF THE DRAWINGS

One embodiment of the instant invention points out further characteristics as well as advantages and is illustrated in greater detail in the appended drawings, wherein.

DETAILED DESCRIPTION

Figure 1:
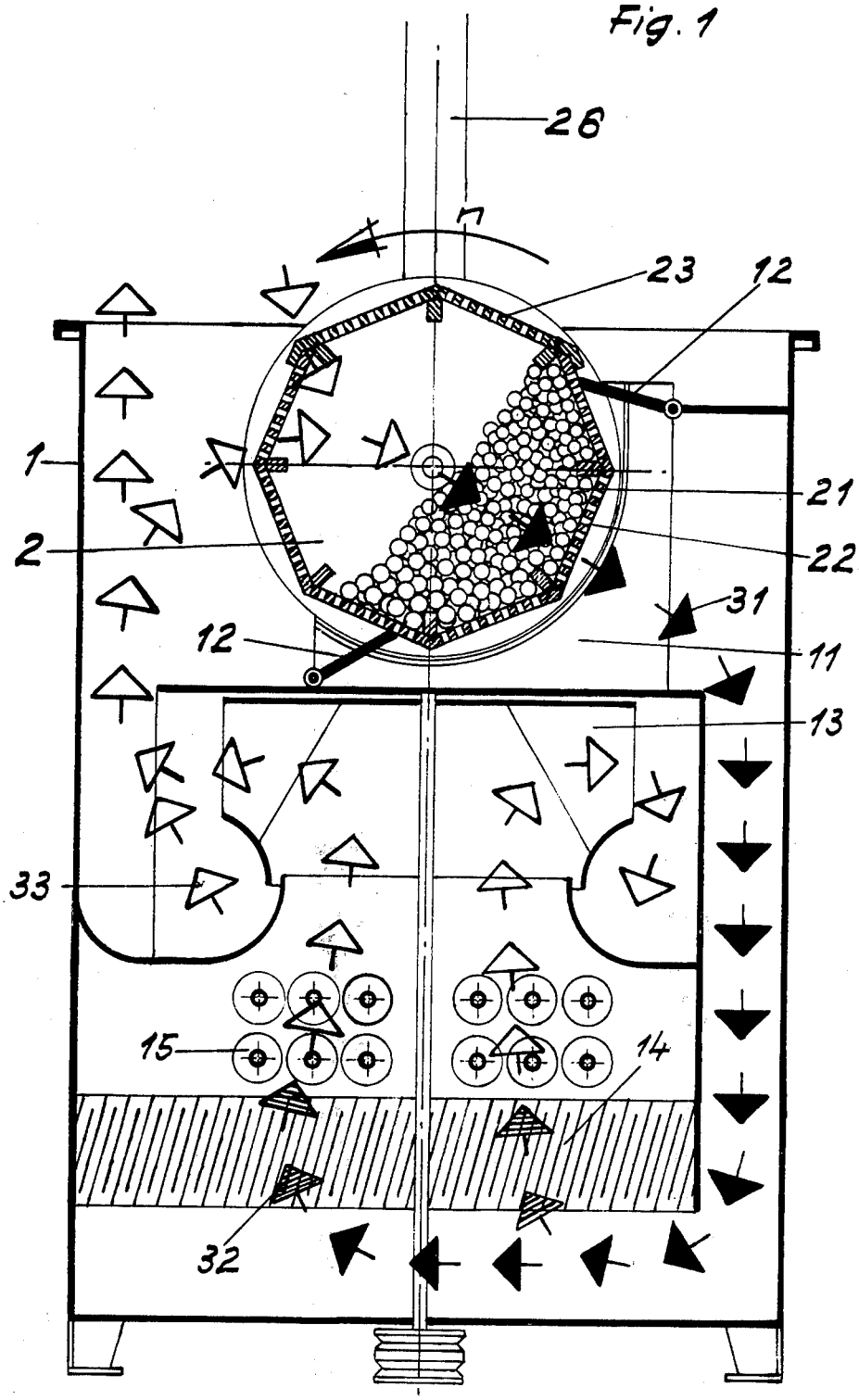
FIG. 1 shows a cross-section through a principally-illustrated drying chamber.
Figure 2:
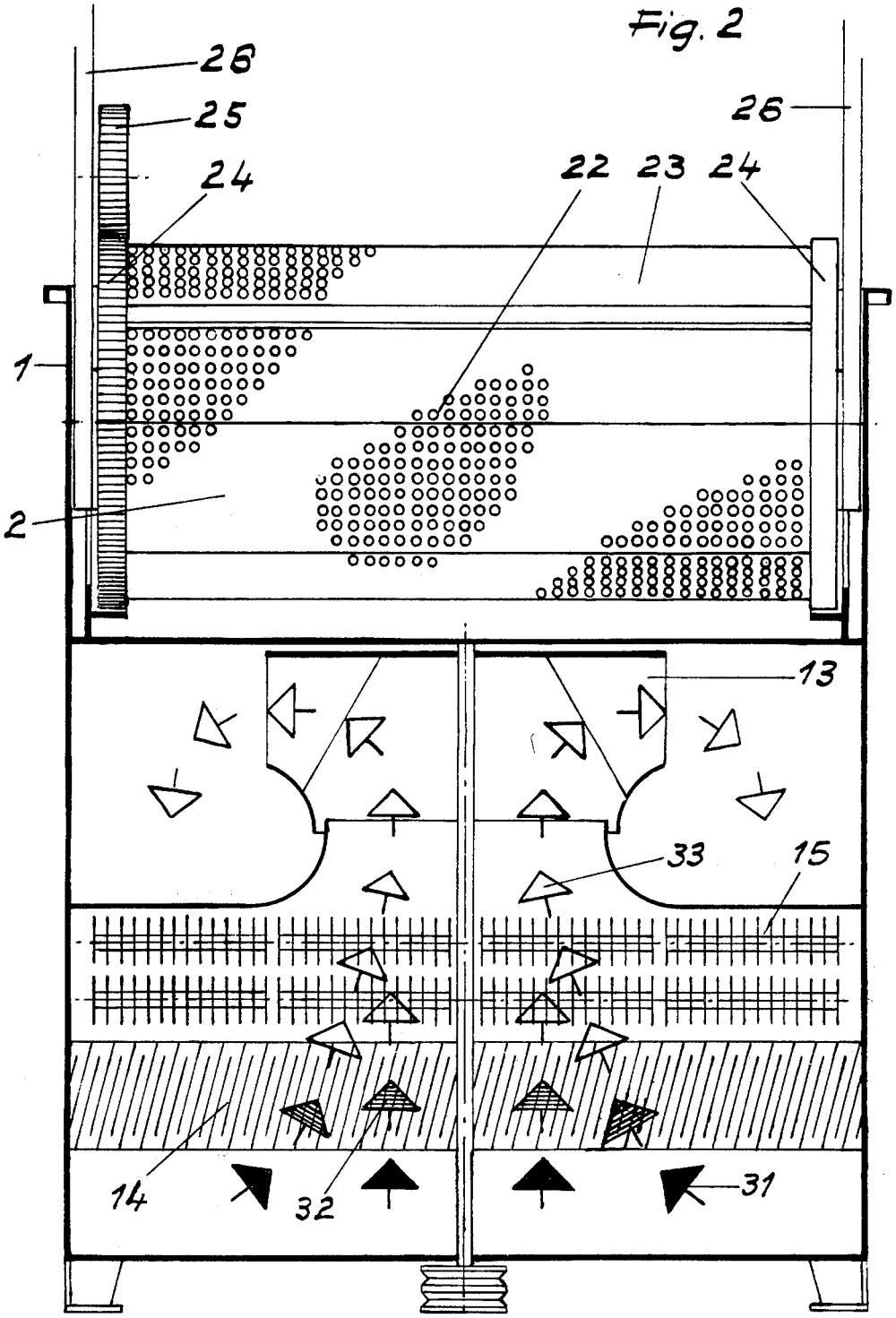
FIG. 2 shows a longitudinal cross section of the drying chamber according to FIG. 1.

The drying chamber is denoted by numeral 1, and the barrel by numeral 2. The chamber 1 forms the corresponding station of a galvanizing plant preferably provided with an automated transporting system.

The barrel 2 is filled with the charge 21 of pieces in bulk and rotates in the direction of the arrow with n rotations per minute.

The barrel 2 comprises substantially the perforated cover 22, the removable lid 23 as well as the two frontal sections 24. One of the two frontal sections 24 is provided on its rim with a toothed wheel; it is rotated by the rotational movement of the drive pinion 25 which is driven by a drive motor, not illustrated in the drawings.

The barrel 2 is secured by means of the two support arms 26. The barrel cover 22 should preferably consist of a thermically highly resistant material, for example of a polypropylene which is reinforced with glass fibers. The perforation should be densily arranged and possibly have a large cross section, so as to produce as little resistance as possible against air passage.

The barrel 2 is placed into the drying chamber, after the charge 21 together with the barrel 2 had first been rinsed preferably with hot water (of about 90° C.). The charge 21 and the barrel 2 have therefore already a high temperature in itself before being placed into the chamber 1, which temperatures has a favorable effect on the evaporation speed of the liquid with which they are wetted.

The suction box 11 is arranged in such a manner so that the charge 21 during the rotation of barrel 2 is located directly opposite its suction opening. The two flexible apendages 12 rest slidingly on the cover 22 of the rotating barrel 2. If there develops an under-pressure in the sealed suction box 11 by means of the radial ventilator 13, then there positively develops the suction stream 31 (shown by the series of black arrows). The indraft stream 31 flows positively straight though the area of the perforated barrel cover 22, which is contacted by the charge 21.

The black arrows symbolize the strong moisture acceptance of the suction stream 31, which continues to move downwards in a vertical direction, in order to reach the dehumidifier 14 and to pass through it. The shaded arrows 32 represent the moisture output of the air flow coming from the barrel 2.

The performance of the dehumidifier 14 is characterized by the degree of output and the smallest removable drops, the socalled borderline drops. If the suction stream 31 loaded with the moisture flows through the tortuous flow-grid of the dehumidifier 14, then inertia-forces will become effective to impinge the drops onto the walls. The size of these forces which lead to the extraction of moisture is predetermined by the inflow speed of the suction stream 31 as well as the degree of moisture of said stream and the geometric conditions in the moisture-extraction grid. The inventive apparatus enables especially high inflow speeds under high moisture contents; it enables therefore an especially intensive and rapid drying of the pieces in charge 21 through a rapid removal of the moisture which wets its surface area.

After leaving the humidifier 14, the dehumidified air 33 (represented by means of a row of white arrows) reaches the radiator 15. The heated drying air 33 is consequently engaged by the radial ventilator 13, and is forced into the upper area of the drying chamber 1. The cycle of the air flow, as shown in the two drawings, is continuous. Before the flow 33 of the hot and dehumidified air flows into the inside of the barrel 2, a portion there of is lost to the surrounding air of the working area; the lost portion, however, is simultaneously replaced by fresh air which is drawn in from the working area. This process is symbolically shown in FIG. 1.

The above-described mixing condition of the air flow which alternates constantly in the cycle, make it generally possible to abandon the need for using a dehumidifier 14 in the drying chamber 1, and to only need the heating radiator 15.

What I claim is:

1. A method for drying pieces in bulk consisting of metals and of synthetic materials, by means of an air flow in a rotating barrel which is suitable for the chemical or galvanic surface treatment of said pieces in bulk, wherein said barrel substantially consists of two frontal areas which are perpendicularly arranged to the axis of rotation of the barrel, and a perforated casing which is mounted between the two frontal areas comprising partially filling the barrel with a charge of said pieces, rotating said barrel in one direction only, directing the air by vacuum flow through the perforations of the barrel from substantially the entire outside and along the entire length thereof from the direction of the empty portion of the barrel only which is not in contact with the charge and guiding the flow of air through substantially all of the charge and out of said barrel through substantially all and only that part of the perforated casing in direct contact with the charge.

2. The method according to claim 1, wherein the barrel is intermittently rotated in a predetermined timed cycle while maintaining the air flow through the barrel continuously.

3. An apparatus for drying pieces in bulk comprising a drying chamber, a perforated barrel mounted for rotation within said drying chamber about its longitudinal axis, means to draw air through said barrel, said barrel being only partially filled with a charge of pieces to be dried, means to rotate said barrel in one direction only and at such a speed to ensure that only a portion of the barrel is in direct contact with the charge at any one time, said chamber comprising an outer casing defining a duct means for the flow of air, a suction box within said chamber having an opening adjacent that portion of the barrel which is in direct contact with the charge, flexible sealing means mounted on said suction box at said opening and extending toward said barrel and into sliding engagement with the outer surface thereof at that part of said barrel which is in direct contact on its inner surface with the charge and substantially adjacent the edges thereof when the barrel is rotating at operating speed, said suction box, sealing means and chamber casing being structurally arranged with respect to each other and said barrel so that during operation the flow of air which enters into said barrel through substantially all and only that part of the perforated barrel casing which is not in direct contact with said charge, then is guided through the empty portion and out of said barrel through said charge and substantially all and only that part of the perforated barrel casing which is in direct contact with said charge.

4. The apparatus of claim 3 wherein said sealing means comprises elongated flaps of flexible, thermally high stressable material mounted at one edge adjacent the longitudinal edges of said suction box opening which are substantially parallel to the axis of rotation of said barrel, and slidably contacting in sealing engagement the outer surface of said barrel casing along their other edges.

5. The apparatus of claim 4 wherein said means to draw air through said barrel comprises a radial ventilator having its inlet communicating with said suction box and its outlet communicating with that part of the barrel not in direct contact with said charge, said apparatus further comprising a heating radiator and a dehumidifier provided within said drying chamber between said suction box and said ventilator inlet.

* * * * *